US010925378B2

(12) United States Patent
Moon

(10) Patent No.: US 10,925,378 B2
(45) **Date of Patent: *Feb. 23, 2021**

(54) TOOL FOR APPLYING COSMETICS FOR EYELASH

(71) Applicant: INTERWORK KOREA CO., LTD., Siheung-si (KR)

(72) Inventor: Hyun Myung Moon, Yongin-si (KR)

(73) Assignee: INTERWORK KOREA CO., LTD., Siheung-si (KR)

( * ) Notice: Subject to any disclaimer, the term of this patent is extended or adjusted under 35 U.S.C. 154(b) by 54 days.

This patent is subject to a terminal disclaimer.

(21) Appl. No.: 16/011,835

(22) Filed: Jun. 19, 2018

(65) Prior Publication Data

US 2019/0320778 A1 Oct. 24, 2019

(30) Foreign Application Priority Data

Apr. 20, 2018 (KR) ..... 10-2018-0046368

(51) Int. Cl.
*A45D 40/26* (2006.01)
*A46B 5/00* (2006.01)

(52) U.S. Cl.
CPC ..... *A45D 40/265* (2013.01); *A46B 5/0012* (2013.01); *A46B 2200/106* (2013.01)

(58) Field of Classification Search
CPC .. A45D 40/265; A45D 40/267; A45D 34/045; A45D 34/046; A46B 5/0012; A46B 2200/1053; A46B 5/0004; A46B 5/002; A46B 2200/106
See application file for complete search history.

(56) References Cited

U.S. PATENT DOCUMENTS 5,007,442 A * 4/1991 Hirzel ..... A45D 2/48 132/120
6,029,675 A * 2/2000 Dumler ..... A45D 40/265 132/218
8,042,554 B2 * 10/2011 Dumler ..... A46D 1/0253 132/218

(Continued)

*Primary Examiner* — Rachel R Steitz
*Assistant Examiner* — Karim Asqiriba
(74) *Attorney, Agent, or Firm* — Lex IP Meister, PLLC

(57) ABSTRACT

The present invention discloses a tool for applying cosmetics for an eyelash used for applying cosmetics to an eyelash. The tool for applying the cosmetics for the eyelash according to the present invention includes: a container in which a cosmetic is received; a cover coupled to the container; a base tongs part installed on the cover; a brush tongs part hinge-coupled to the base tongs part to be gathered or spread with the base tongs part; a knob installed on the base tongs part and disposed to be protruded outside the cover; an elastic member elastically supported between the base tongs part and the cover and producing an elastic force in a direction where the base tongs part and the brush tongs part are gathered; a tightening ring producing an elastic force in a direction where the base tongs part and the brush tongs part are gathered while enclosing the base tongs part and the brush tongs part; a cosmetics receiving part extending on the base tongs part to provide a receiving groove part along a length direction; and a brush part coupled to the brush tongs part and close to the cosmetics receiving part.

5 Claims, 7 Drawing Sheets

(56) References Cited

U.S. PATENT DOCUMENTS

| | | | | |
|---|---|---|---|---|
| 8,851,775 | B2 * | 10/2014 | Jacob | A45D 40/267<br>401/129 |
| 9,232,851 | B2 * | 1/2016 | Manici | A46B 9/021 |
| 2011/0135376 | A1 * | 6/2011 | Weigel | A45D 40/24<br>401/29 |
| 2013/0206160 | A1 * | 8/2013 | Sanchez | A45D 2/48<br>132/218 |
| 2014/0099152 | A1 * | 4/2014 | Hatch | A45D 40/267<br>401/121 |
| 2014/0246043 | A1 * | 9/2014 | Befve | A46B 3/005<br>132/218 |
| 2016/0367013 | A1 * | 12/2016 | Arredondo | A45D 40/267 |
| 2017/0164718 | A1 * | 6/2017 | Pires | A46B 3/005 |
| 2017/0231368 | A1 * | 8/2017 | Navarro | A45D 40/267<br>132/218 |

* cited by examiner

TOOL FOR APPLYING COSMETICS FOR EYELASH

CROSS-REFERENCE TO RELATED APPLICATION

This application claims priority to and the benefit of Korean Patent Application No. 10-2018-0046368 filed in the Korean Intellectual Property Office on Apr. 20, 2018, the entire contents of which are incorporated herein by reference.

BACKGROUND OF THE INVENTION

(a) Field of the Invention

The present invention relates to a tool for applying cosmetics for an eyelash which is used to apply the cosmetics to the eyelash.

(b) Description of the Related Art

In general, a tool for applying cosmetics for an eyelash is a device for applying the cosmetics to the eyelash. Tools for applying the cosmetics for the eyelash are disclosed in U.S. Patent Publication U.S. Pat. No. 9,730,503. The above-mentioned publication discloses a tool for applying the cosmetics for the eyelash as a tongs type in which two brushes are provided in a container containing the cosmetics for the eyelash. In the technique disclosed in the above-mentioned publication, as the container is maintained in a closed and sealed state in a state where the tool for applying the cosmetics for the eyelash is inserted into the container, it is possible to prevent the cosmetics for the eyelash contained in the container from settling or being oxidized.

In this conventional art, two brushes connected to the tongs part are kept in close contact with each other and the cosmetic article is applied to the eyelashes. That is, in the conventional art, the cosmetics are applied to the eyelash in the state in which two brushes are in contact with each other. In the conventional art, there are difficulties in uniformly applying the cosmetics, and there is a point that a curling effect of the eyelash may not be sufficiently exerted.

Also, in the conventional art, when two brushes are in contact with each other while the tongs parts are repeatedly forced to each other, there is a drawback in which a phenomenon that one of the two brushes is bent due to the mutual action force and adhesion strength of the brushes is reduced.

The above information disclosed in this Background section is only for enhancement of understanding of the background of the invention and therefore it may contain information that does not form the prior art that is already known in this country to a person of ordinary skill in the art.

SUMMARY OF THE INVENTION

Accordingly, the present invention, to solve the above-described problems, provides a tool for applying cosmetics for the eyelash with improved ease of usage by applying the cosmetics in a uniform amount to the eyelash with a minimal operation and simultaneously maximizing the curling effect of the eyelash when a user applies the cosmetics to the eyelash.

Also, the present invention provides the tool for applying the cosmetics for the eyelash with improved merchantability by preventing the tongs part from being deformed by an external force even when being repeatedly used by the user.

The tool for applying the cosmetics for the eyelash according to the present invention includes: a container in which a cosmetic is received; a cover coupled to the container; a base tongs part installed on the cover; a brush tongs part hinge-coupled to the base tongs part to be gathered or spread with the base tongs part; a knob installed on the base tongs part and disposed to be protruded outside the cover; an elastic member elastically supported between the base tongs part and the cover and producing an elastic force in a direction where the base tongs part and the brush tongs part are gathered; a tightening ring producing an elastic force in a direction where the base tongs part and the brush tongs part are gathered while enclosing the base tongs part and the brush tongs part; a cosmetics receiving part extending on the base tongs part to provide a receiving groove part along a length direction; and a brush part coupled to the brush tongs part and close to the cosmetics receiving part.

It is preferable that the receiving groove part formed at the cosmetics receiving part is made as a curved part with a rounded shape of which a surface in contact with the brush part is concave based on a cross-sectional cut in a direction perpendicular to a length direction.

It is preferable that the cosmetics receiving part includes a deformation preventing groove part of which a part is dug along a length direction on the part thereof.

It is preferable that the base tongs part includes a long groove part formed along a length direction.

It is preferable that the cosmetics receiving part includes an external circumference side that is made of a rounded shape and a plurality of cosmetics applying groove parts and protrusion parts are continuously formed in a direction perpendicular to a length direction.

It is preferable that the cosmetics applying groove parts and the protrusion part are further protruded to the brush part side based on both ends of the curved part that is in contact with the brush part.

It is preferable that the brush part is insert-coupled to the brush tongs part and includes brushes on the entire external circumferential surface.

According to the present invention, the interior circumference of the cosmetics receiving part facing the brush part is formed of the curved part with the concave and rounded shape such that the user may obtain the curling effect of the eyelash with a minimum operation.

Also, according to the present invention, the long groove part is formed along the length direction on the base tongs part and the deformation preventing part of the groove shape is formed on the cosmetics receiving part of the part in contact with the brush part. In addition, the present invention may prevent the cosmetics receiving part from being twisted or deformed by the external force even if the tool for applying the cosmetics for the eyelash is repeatedly used. Accordingly, as the present invention maintains the state that the cosmetics receiving part and the brushes of the brush part are close to each other, the cosmetics may be uniformly applied to the eyelash with a minimum amount and the curling effect may be also maximized. Also, the present invention may increase the merchantability of the tool for applying the cosmetics for the eyelash.

DETAILED DESCRIPTION OF THE EMBODIMENTS

Figure 1:
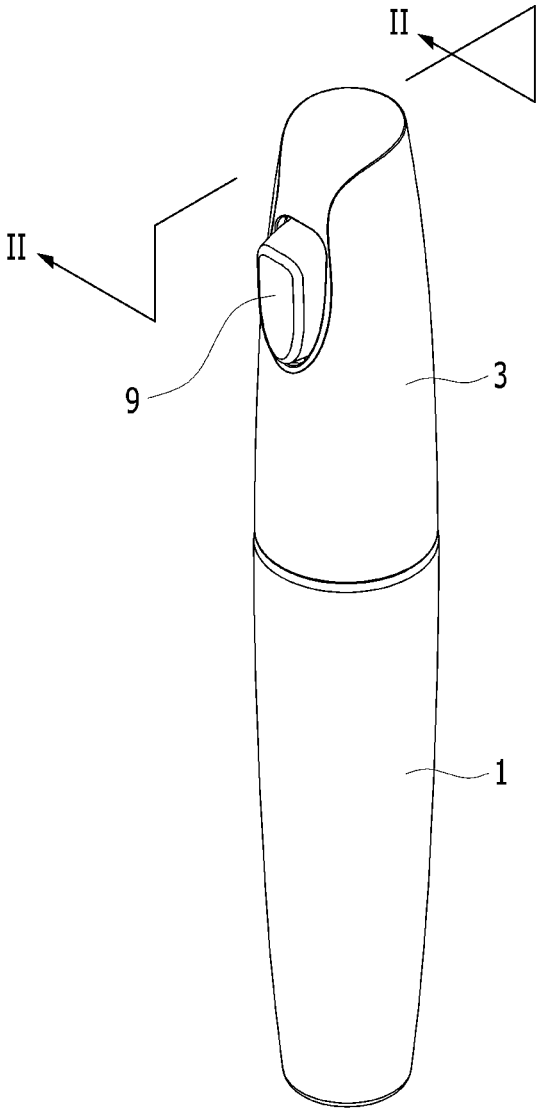
FIG. 1 is a view showing an outline of a tool for applying cosmetics for an eyelash to explain an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
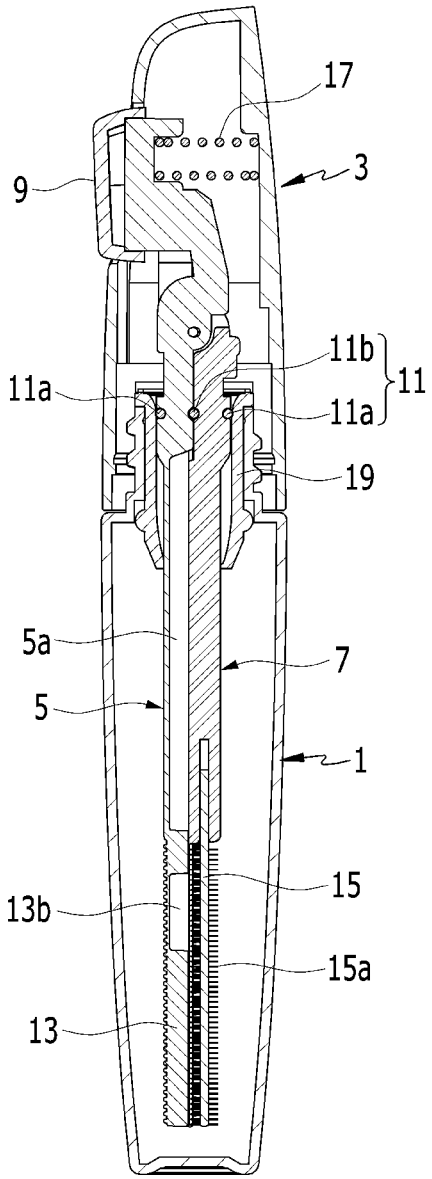
FIG. 2 is a cross-sectional view taken along a line II-II of FIG. 1.
Figure 3:
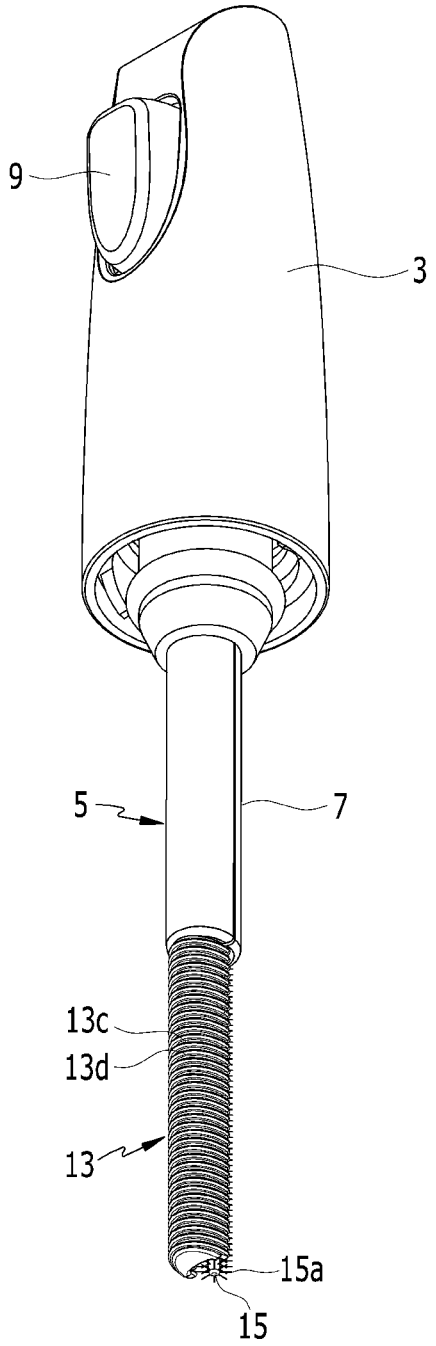
FIG. 3 is a view showing a main part of an exemplary embodiment of the present invention.
Figure 4:
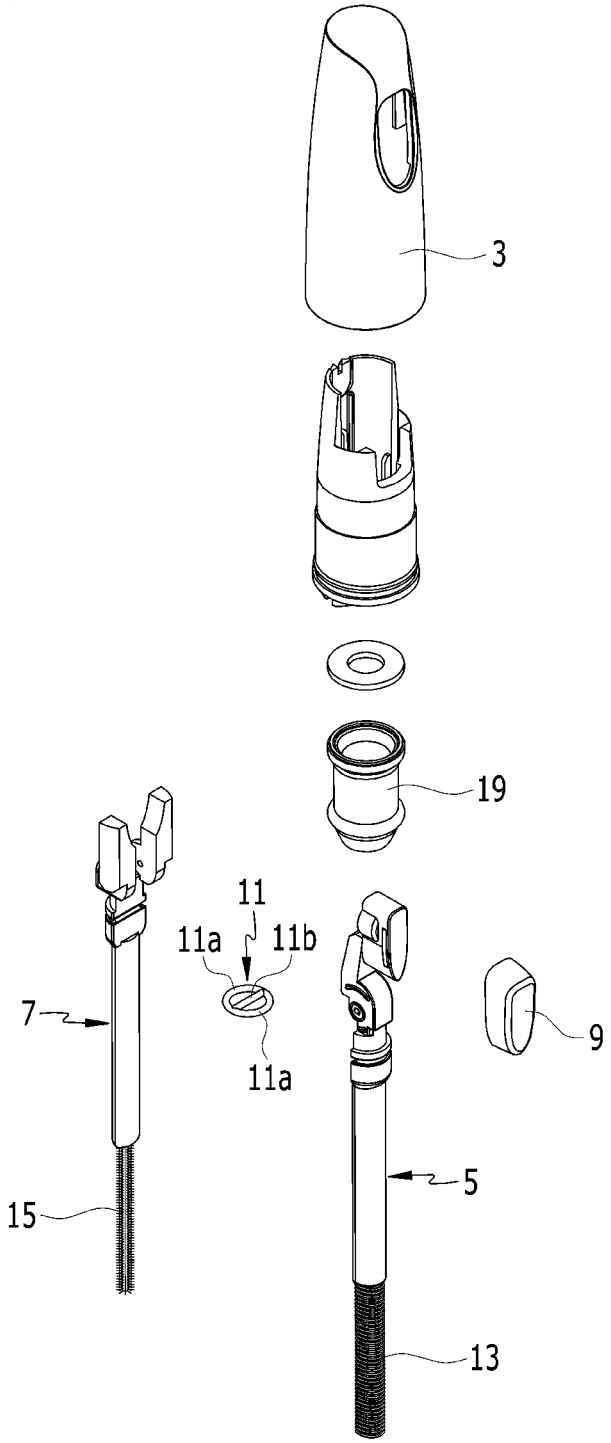
FIG. 4 is an exploded perspective view showing a decomposition of FIG. 3.

FIG. 1 is a view showing an outline of a tool for applying cosmetics for an eyelash to explain an exemplary embodiment of the present invention, FIG. 2 is a cross-sectional view taken along a line II-II of FIG. 1, FIG. 3 is a view showing a main part of an exemplary embodiment of the present invention, and FIG. 4 is an exploded perspective view showing a decomposition of FIG. 3.

A tool for applying cosmetics for an eyelash according to an exemplary embodiment of the present invention includes a container 1, a cover 3, a base tongs part 5, a brush tongs part 7, a knob 9, a tightening ring 11, a cosmetics receiving part 13, and a brush part 15. Also, the tool for applying the cosmetics for the eyelash according to an exemplary embodiment of the present invention further includes an elastic member 17 of which an elastic force is produced in a direction such that the base tongs part 5 and the brush tongs part 7 are in contact with each other.

The container 1 is a cylinder made with a relatively long form and in which liquid eyelash cosmetics may be accommodated. Also, a screw thread is provided on the external circumferential surface of the inlet part so that the container 1 may be combined with the cover 3.

In addition, packing 19 is inserted to the inlet part side in the container 1. The packing 19 plays a role of preventing the interior of the container 1 to be closed and sealed from the outside in a state where the packing 19 is in close contact with the tightening ring 11 such that the cover 3 is connected to the container 1. Accordingly, the packing 19 and the tightening ring 11 may prevent the cosmetics housed inside the container 1 from deteriorating. The packing 19 may be made of a rubber or silicon material.

In the cover 3, a screw groove corresponding to the screw thread provided on the container 1 is provided on the interior circumference. Accordingly, the cover 3 may be fixed to the container 1 by screw coupling.

The base tongs part 5 and the brush tongs part 7 are hinge-coupled to each other, and a part thereof is disposed on the cover 3. While the base tongs part 5 and the brush tongs part 7 are entirely rotated based on the hinge-coupled part, the cosmetics receiving part 13 and the brush part 15 may gather or spread with respect to each other.

The knob 9 may be provided on one side of the base tongs part 5 to be protruded outside the cover 3. Accordingly, the user may widen the interval between the base tongs part 5 and the brush tongs part 7 with the operation of only pushing the knob 9.

Figure 5:
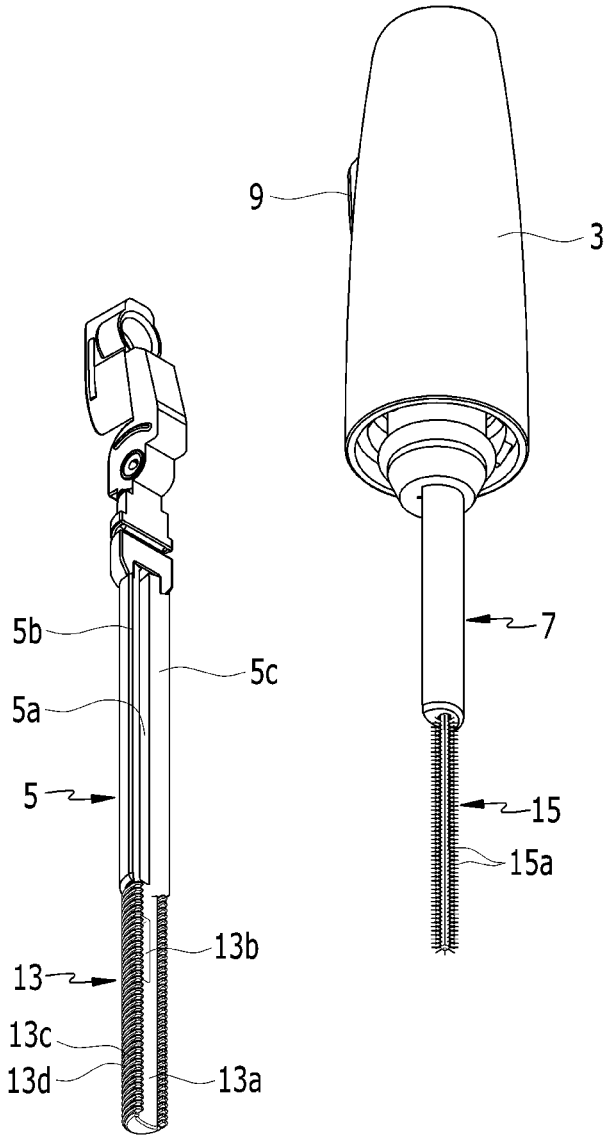
FIG. 5 is an exploded view of a part of FIG. 3.

The base tongs part 5 forms a long groove part 5*a* along a length direction (referring to FIG. 2). The long groove part 5*a* formed on the base tongs part 5 is formed as a groove of a shape that is opened in the direction facing the brush tongs part 7. On the long groove part 5*a* of the base tongs part 5, both sides thereof form pillar parts 5*b* and 5*c* along the length direction (referring to FIG. 5). These pillar parts 5*b* and 5*c* may prevent the base tongs part 5 from being deformed such as being bent or twisted by an external force. In other words, the base tongs part 5 is made in a very long and narrow shape, so it may be easily twisted or deformed due to the external force, but the pillar parts 5*b* and 5*c* of the base tongs part 5 play the role of the pillar and increase the rigidity, thereby enduring the force in the direction that is in contact with the brush part 15. Therefore, the base tongs part 5 may be prevented from being easily twisted or being deformed by the external force.

On the other hand, on the base tongs part 5, the front end thereof extends to form the cosmetics receiving part 13.

It is preferable that the cosmetics receiving part 13 is molded integrally with the base tongs part 5. In an exemplary embodiment of the present invention, for the cosmetics receiving part 13, a part that is in contact with the brush part 15 is referred to as an interior circumference side or an interior circumference, and a part opposite thereto is referred to as an external circumference side or an external circumferential surface.

Figure 6:
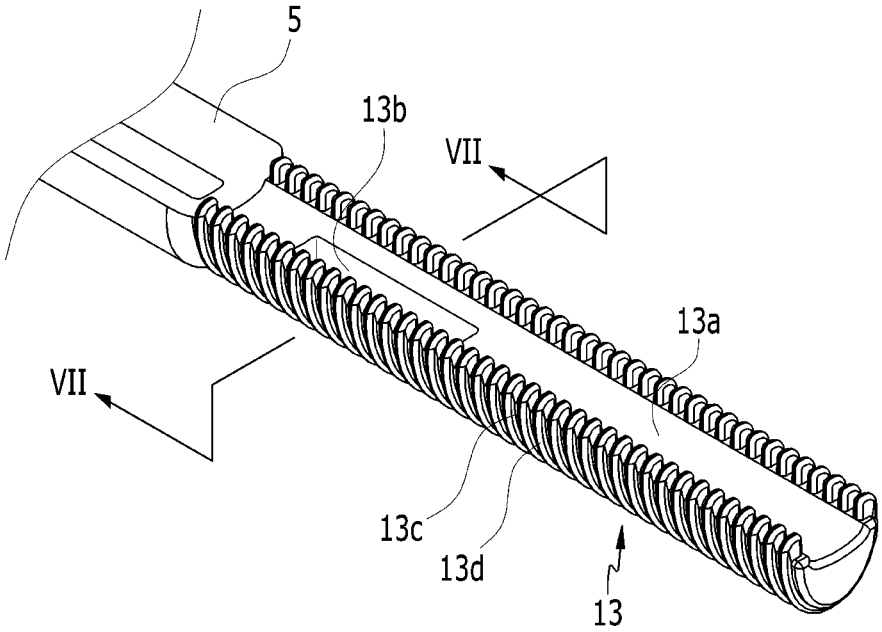
FIG. 6 is a detailed view of a part of a base tongs part to explain an exemplary embodiment of the present invention.
Figure 7:
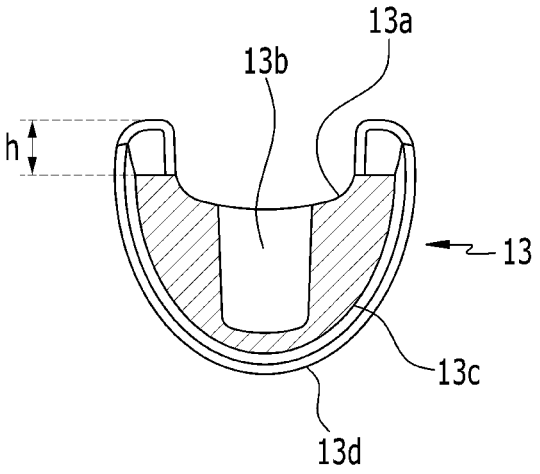
FIG. 7 is a cross-sectional view taken along a line VII-VII of FIG. 6.

The cosmetics receiving part 13, as shown in FIG. 6 and FIG. 7, is formed of a curved part 13*a* on the basis of the cross-section taken along the direction perpendicular to the length direction of the interior circumference. The curved part 13*a* of the cosmetics receiving part 13 is formed of a rounded shape that is concave in the width direction based on the contact surface of the brush part 15. The curved part 13*a* of the cosmetics receiving part 13 receives the cosmetics and plays a role of maximizing the curling effect of the eyelash when the user applies the cosmetics to the eyelash.

On the other hand, the cosmetics receiving part 13 provides a deformation preventing part 13*b* of a groove shape along the length direction on the interior circumference side. The deformation preventing part 13*b* of the cosmetics receiving part 13 serves as a reinforcing pillar on the parts of both sides thereof, and serves to buffer the force when the cosmetics receiving part 13 receives a force. Therefore, the base tongs part 5 and the cosmetics receiving part 13 may prevent the displacement and the deformation after being molded. The deformation preventing part 13*b* of the cosmetics receiving part 13 may prevent a deviation and warping despite the action of the base tongs part 5 and the brush tongs part 7 repeatedly contacting for the reasons described above. Therefore, the cosmetics receiving part 13 may maintain the state of being in close contact with the brush part 15, thereby improving the merchantability of the tool for applying the cosmetics for the eyelash.

On the other hand, cosmetics applying groove parts 13*c* and a protrusion part 13*d* are formed on the external circumferential surface of the cosmetics receiving part 13. The cosmetics applying groove parts 13*c* and the protrusion part 13*d* are formed in the direction perpendicular to the length direction of the cosmetics receiving part 13. The cosmetics applying groove parts 13*c* and the protrusion part 13*d* are repeatedly disposed in plural along the length direction.

The cosmetics applying groove parts 13*c* may be disposed between the protrusion parts 13*d*. The cosmetics applying groove parts 13*c* may be used when receiving and applying the cosmetics to the eyelash. When applying the cosmetics to the eyelash, the cosmetics applying groove parts 13*c* may have the role of entering the eyelash between the cosmetics applying groove parts 13*c* and uniformly applying the cosmetics to the eyelash.

The cosmetics applying groove parts 13*c* and the protrusion part 13*d* may be formed to be protruded upward by a height h (referring to FIG. 7) based on both interior circumference ends of the cosmetics receiving part 13. That is, the cosmetics may be uniformly applied to the eyelash even in one operation of the user by ensuring the entire length of the cosmetics applying groove parts 13*c* in maximum.

On the other hand, the brush part 15 may be insert-coupled to the brush tongs part 7. In the brush part 15, it is preferable that brushes 15*a* are disposed in all directions on the entire external circumferential surface. Accordingly, the brushes 15*a* are close to the eyelash along with the cosmetics receiving part 13 while applying the cosmetics to the eyelash on the part that is in contact with the interior circumference of the cosmetics receiving part 13, thereby executing the curling operation. Also, in the brushes 15*a*, the opposite part that is in contact with the interior circumference of the cosmetics receiving part 13 may be used for applying the cosmetics to the eyelash. The tool for applying the cosmetics for the eyelash according to an exemplary embodiment of the present invention may be used for applying cosmetics of an appropriate amount to the eyelash as necessary while maximizing the curling function of the eyelash.

On the other hand, the tightening ring 11 is disposed while enclosing the external circumferential surface of the base tongs part 5 and the brush tongs part 7, and may be made of an elastomer producing an elastic force in the direction for gathering the base tongs part 5 and the brush tongs part 7. The tightening ring 11 may be made of the rubber, the silicon, or a synthetic resin material having excellent elastic force. The tightening ring 11 according to an exemplary embodiment of the present invention includes a first closing and sealing part 11*a* and a second closing and sealing part 11*b*.

The first closing and sealing part 11*a* is formed with a ring shape, and is disposed to enclose the external circumferential surface of the base tongs part 5 and the brush tongs part 7. Further, the first closing and sealing part 11*a* may be close to the inner wall of the packing 19.

In addition, the second closing and sealing part 11*b* is formed with a shape of which the center part of the first closing and sealing part 11*a* made of the circular shape extends. The second closing and sealing part 11*b* is disposed between the base tongs part 5 and the brush tongs part 7. Accordingly, the second closing and sealing part 11*b* closes and seals between the first tongs part 5 and the second tongs part 7 to block the external air.

The operation of the tool for applying the cosmetics for the eyelash according to an example embodiment carried out in this manner will be described in detail as follows.

First, the user rotates the cover 3 to separate the cover 3 from the container 1. If the cover 3 is drawn out to the container 1, the cosmetics for the eyelash are adhered to the cosmetics receiving part 13 and the brush part 15. In this case, the cosmetics may be received in the cosmetics applying groove parts 13*c* and may be simultaneously received in the curved part 13*a* of the cosmetics receiving part 13.

Figure 8:
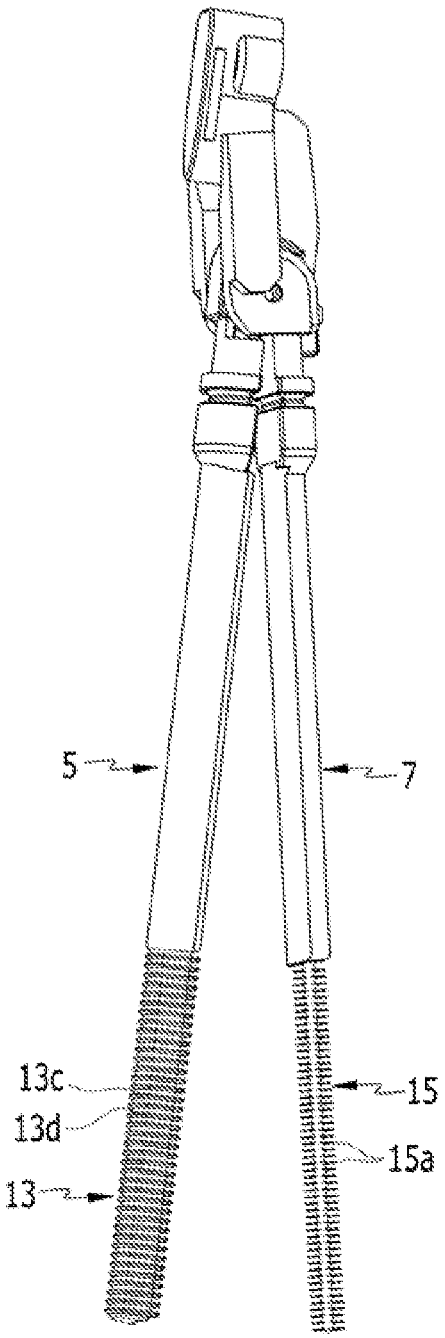
FIG. 8 is a view to explain an operation of an exemplary embodiment of the present invention.

In this state, if the user pushes the knob 9, the base tongs part 5 and the brush tongs part 7 overcome the elastic force of the tightening ring 11 and the elastic member 17 and are spread with respect to each other. While the base tongs part 5 and the brush tongs part 7 are spread, the cosmetics receiving part 13 and the brush part 15 are also spread (referring to FIG. 8).

The user releases the pressing state of the pressed knob 9 after the eyelash is positioned between the cosmetics receiving part 13 and the brush part 15. Thereby, the cosmetics receiving part 13 and the brush part 15 are in close contact with each other across the eyelash. Then, the user lifts the eyelash as if to comb. Thus, the cosmetics are applied to the eyelash while the cosmetics for the eyelash adhered to the cosmetics receiving part 13 and the brush part 15 are uniformly applied to the eyelash. At this time, since the curved part 13*a* of the cosmetics receiving part 13 and the brushes 15*a* sufficiently maintain the contact state, the eyelash curling may be performed naturally by the curved part 13*a* of the cosmetics receiving part 13. Also, since the curved part 13*a* of the cosmetics receiving part 13 and the brushes 15*a* of the brush part 15 maintain the adequate adhesion state, the cosmetics may be uniformly applied to the eyelash.

Accordingly, the tool for applying the cosmetics for the eyelash according to an exemplary embodiment of the present invention minimizes the action with which the user applies the cosmetics to the eyelash for curling the eyelash, thereby being easier to use and enhancing the merchandising.

Also, if the eyelash makeup is completed, the user rotates the cover 3 to be joined to the container 1. Thus, while the first closing and sealing part 11*a* of the tightening ring 11 is closely attached to the inner wall of the packing 19, the inside of the container 1 and the external air of the container 1 may be blocked. At the same time, as the second closing and sealing part 11*b* closes and seals between the base tongs part 5 and the brush tongs part 7, it is possible to block the external air from passing through the container 1 between the base tongs part 5 and the brush tongs part 7.

According to an exemplary embodiment of the present invention, the cosmetics for the eyelash received inside the container 1 is not in contact with the external air such that the tool for applying the cosmetics for the eyelash may be kept for the relatively long time, thereby improving the merchantability thereof.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

| | |
|---|---|
| 1. container | 3. cover |
| 5. base tongs part | 5a. long groove part |
| 5b, 5c. pillar part | |
| 7. brush tongs part | 9. knob |
| 11. tightening ring | 11a. first closing and sealing part |
| 11b. second closing and sealing part | |
| 13. cosmetics receiving part | |

-continued

| | |
|---|---|
| 13a. curved part | 13b. deformation preventing part |
| 13c. cosmetics applying groove parts | 13d. protrusion part |
| 15. brush part | 15a. brush |
| 17. elastic member | 19. packing |

What is claimed is:

1. A tool for applying cosmetics for an eyelash, comprising:

a container in which a cosmetic is received;

a cover coupled to the container;

a base tongs part installed on the cover;

a brush tongs part hinge-coupled to the base tongs part to be gathered or spread with the base tongs part;

a knob installed on the base tongs part and disposed to be protruded outside the cover;

an elastic member elastically supported between the base tongs part and the cover and producing an elastic force in a direction where the base tongs part and the brush tongs part are gathered;

a tightening ring producing an elastic force in a direction where the base tongs part and the brush tongs part are gathered while enclosing the base tongs part and the brush tongs part;

a cosmetics receiving part extending on the base tongs part to provide a receiving groove part along a length direction; and a brush part coupled to the brush tongs part and close to the cosmetics receiving part, wherein the cosmetics receiving part includes an external circumference side that has a rounded surface and a plurality of cosmetics applying groove parts and a plurality of cosmetics applying protrusion parts disposed on the rounded surface, wherein the cosmetics applying protrusion parts are parallel threads extending along the rounded surface in a direction perpendicular to the length direction of the cosmetics receiving part and wherein the cosmetic applying groove parts are parallel valleys formed between the cosmetics applying protrusion parts, and wherein the receiving groove part formed at the cosmetics receiving part is made as a curved part with a rounded shape of which a surface in contact with the brush part is concave based on a cross-sectional cut in a direction perpendicular to a length direction.

2. The tool for applying the cosmetics for the eyelash of claim 1, wherein the cosmetics receiving part includes a deformation preventing groove part of which a part is dug along a length direction on the part thereof.

3. The tool for applying the cosmetics for the eyelash of claim 1, wherein the base tongs part includes a long groove part formed along a length direction.

4. The tool for applying the cosmetics for the eyelash of claim 1, wherein the cosmetics applying groove parts and the protrusion part are further protruded to the brush part side based on both ends of the curved part that is in contact with the brush part.

5. The tool for applying the cosmetics for the eyelash of claim 1, wherein the brush part is insert-coupled to the brush tongs part and includes brushes on the entire external circumferential surface.

* * * * *